US009353695B2

(12) United States Patent
Sata et al.

(10) Patent No.: US 9,353,695 B2
(45) Date of Patent: May 31, 2016

(54) CONTROL DEVICE FOR INTERNAL COMBUSTION ENGINE

(75) Inventors: Kota Sata, Susono (JP); Yasuhiro Oi, Numazu (JP); Shinichi Soejima, Gotemba (JP); Koichi Ueda, Susono (JP); Shuntaro Okazaki, Sunto-gun (JP); Satoshi Yoshizaki, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 1069 days.

(21) Appl. No.: 13/498,775

(22) PCT Filed: Jan. 14, 2010

(86) PCT No.: PCT/JP2010/050348

§ 371 (c)(1),
(2), (4) Date: Mar. 28, 2012

(87) PCT Pub. No.: WO2011/086679

PCT Pub. Date: Jul. 21, 2011

(65) Prior Publication Data

US 2012/0185148 A1 Jul. 19, 2012

(51) Int. Cl.
*F02D 41/26* (2006.01)
*F02D 41/14* (2006.01)

(52) U.S. Cl.
CPC ..... *F02D 41/1497* (2013.01)

(58) Field of Classification Search
CPC . F02D 41/1497; F02D 41/24; F02D 41/2425; F02D 41/26; F02D 43/00; F02D 2200/02; F02D 2200/10; F02D 2200/50; F02D 2200/60
USPC ..... 701/102, 106
See application file for complete search history.

(56) References Cited

U.S. PATENT DOCUMENTS

| | | | |
|---|---|---|---|
| 2004/0014561 | A1 | 1/2004 | Jessen |
| 2010/0211246 | A1 | 8/2010 | Kawai |
| 2010/0211287 | A1 | 8/2010 | Ohtsuka et al. |

FOREIGN PATENT DOCUMENTS

| | | |
|---|---|---|
| JP | 2004 52769 | 2/2004 |
| JP | 2008 169825 | 7/2008 |
| JP | 2009 162199 | 7/2009 |
| JP | 2009 162200 | 7/2009 |
| JP | 2009 167916 | 7/2009 |
| JP | 2009 197720 | 9/2009 |

OTHER PUBLICATIONS

International Search Report Issued Feb. 9, 2010 in PCT/JP10/50348 Filed Jan. 14, 2010.

*Primary Examiner* — Hai Huynh
(74) *Attorney, Agent, or Firm* — Oblon, McClelland, Maier & Neustadt, L.L.P

(57) ABSTRACT

A control device acquires various requests concerning the performance of an internal combustion engine and sets a request-specific constraint on a control amount value. The constraint is expressed as a set of constraint index values assigned to individual control amount values, and the distribution of the constraint index values is varied in accordance with the type of a request. The control device integrates the constraint index values for each control amount value and then, in accordance with the distribution of the integrated constraint index value for a control amount, determines a limitation of the control amount. The control device determines a target control amount value within the limitation and controls the internal combustion engine in accordance with the target control amount.

17 Claims, 11 Drawing Sheets

CONTROL DEVICE FOR INTERNAL COMBUSTION ENGINE

TECHNICAL FIELD

The present invention relates to a control device that controls an internal combustion engine in accordance with target control amount values, and more particularly to a control device that can make various requests concerning internal combustion engine performance be reflected in the target control amount values when they are to be determined.

BACKGROUND ART

It is demanded that an automotive internal combustion engine fulfill requests concerning various performance characteristics such as drivability, emissions performance, and fuel consumption rate. The requests concerning the various performance characteristics are issued from an overall vehicle control device to an internal combustion engine control device. The internal combustion engine control device controls control amounts of the internal combustion engine in order to fulfill such requests. However, it is difficult to fulfill all such requests completely and simultaneously. Therefore, it is necessary to devise a scheme for successfully making the various requests be reflected in the control amounts of the internal combustion engine.

Examples of such a scheme are disclosed in JP-A-2009-162199 and JP-A-2008-169825. Internal combustion engine control devices described in JP-A-2009-162199 and JP-A-2008-169825 perform a request mediation process to make various requests be reflected in the control amounts of the internal combustion engine. In the request mediation process, at first, each request is expressed by a predefined physical quantity. The physical quantity is used as a control amount for the internal combustion engine. The physical quantity includes, for instance, a torque, an efficiency, or an air-fuel ratio. The efficiency is the ratio of an actually output torque to a torque that can be potentially output from the internal combustion engine. Next, request values expressed by the same physical quantity are collected. One value is then determined from a plurality of collected request values in accordance with predetermined calculation rules. This determination process is referred to as mediation.

The calculation rules for mediation can be set up as desired. However, if the calculation rules are inappropriate, only requests having relatively high priority may be reflected in a final mediation value, that is, a target control amount value, while requests having relatively low priority are left unreflected. To properly control the internal combustion engine, it is necessary to make not only requests having relatively high priority but also requests having relatively low priority be reflected as appropriate in the target control amount value.

As regards the above matter, an effective solution is described in JP-A-2009-162199. A mediation method disclosed in JP-A-2009-162199 does not express a request with one numerical value, but expresses it in the form of a request value range and of an expected value distribution indicative of the degree of expectation of each request value within the request value range. The sum of expected values of all requests expressed by the same physical quantity is then calculated. Eventually, a request value that maximizes the sum is calculated as the mediation value, that is, the target control amount value. When the above-described mediation method is used to determine the target control amount value, all requests including those having relatively low priority can be reflected in the target control amount value in accordance with their importance.

In the above-described "request mediation," it is assumed that requests to be mediated are expressed by the same physical quantity, or more precisely, expressed by a physical quantity used as a control amount. Therefore, it is necessary that all requests issued from a vehicle control device to an internal combustion engine control device be expressed in the form of a requested control amount value. However, using the form of a specific requested control amount value may not always be appropriate depending on the type or description of a request. In such a case, a request may not be properly reflected in a target control amount value.

SUMMARY OF THE INVENTION

The present invention has been made in view of the above circumstances. An object of the present invention is to provide an internal combustion engine control device that is capable of making various requests concerning internal combustion engine performance be reflected in target control amount values while the requests need not be expressed in the form of a requested control amount value.

In accomplishing the above-mentioned object, according to a first aspect of the present invention, there is provided an internal combustion engine control device that acquires various requests concerning internal combustion engine performance and sets a request-specific constraint for the value of a control amount. More specifically, the control device expresses constraints to be set for control amount values as a set of constraint index values assigned to individual control amount values, and varies the distribution of the constraint index values assigned to the control amount values in accordance with the type of a request. Next, the control device integrates, for each control amount value, the constraint index values assigned to individual requests with respect to each control amount value. Then, in accordance with the distribution of the integrated constraint index value for a control amount, the control device determines a limitation of the control amount, which is defined by an upper-limit value and a lower-limit value. Finally, the control device determines a target control amount value within the range of the determined limitation.

When the above-described process is performed, various requests concerning internal combustion engine performance are converted to a constraint on a control value amount. The various requests are then reflected in a target control amount value through the constraint. Therefore, each request need not be expressed beforehand in the form of a requested control amount value. Further, the integrated constraint index value is an integrated value of a constraint index value for each control amount value, which is assigned to each request with respect to each control amount value. According to the integrated constraint index value, therefore, the level of satisfaction of each control amount value with the entire request can be quantitatively evaluated. As the limitation used for determining the target control amount value is determined in accordance with the distribution of such an integrated constraint index value for a control amount, all requests including those having relatively low priority are properly reflected in the target control amount value.

In the above-described aspect, the constraint index value to be assigned to each control amount value may be either a discrete value assigned to each of a plurality of bands into which a control amount is divided or a continuous value that is continuous in each control amount value.

Further, it is preferred that the distribution of the constraint index value assigned to each control amount value not only vary with the type of a request but also vary with a change in the description of the request. When, for instance, the constraint index value is a discrete value assigned to each band, it is possible to change the constraint index value of each band to a different numerical value in accordance with a change in the description of a request, change the width of each band, or change the constraint index value of each band to a different numerical value in accordance with a change in the description of a request and change the width of each band. When, on the other hand, the constraint index value is a continuous value, the shape of its distribution can be changed with a high degree of freedom.

Further, in the above-described aspect, the constraint index value assigned to each request with respect to each control amount value can be weighted in accordance with the importance of each request. In such an instance, the control device integrates the weighted constraint index value for each control amount value and determines a control amount limitation in accordance with the distribution of the integrated constraint index value. When the above-described process is performed, the importance of each request can be reflected in the setting of a target control amount value.

In the above-described aspect, it is preferred that either of the following two policies be employed when a constraint index value is to be assigned to each control amount value. A first policy is to assign the constraint index value such that the more appropriate the control amount value is for the description of a request, the greater the constraint index value assigned to the control amount value will be with reference to zero or other predetermined finite value. When the first policy is employed, the greater the constraint index value assigned to the control amount value is, the smaller the deviation between the target control amount value and the constraint index value can be lead to.

When the first policy is employed, it is preferred that either of the following two methods be used to determine the control amount limitation. A first method is to use a limitation that represents a band in which the integrated constraint index value is greater than a predetermined threshold value. A second method is to select such a threshold value that a band in which the constraint index value is greater than the threshold value has a predetermined width, and use a limitation that represents a band defined by the selected threshold value. When the first method is employed, it is preferred that the predetermined threshold value vary with the operating environment of the internal combustion engine. When the second method is employed, it is preferred that the predetermined width vary with the operating environment of the internal combustion engine.

A second policy is to assign the constraint index value such that the more inappropriate the control amount value is for the description of a request, the greater the constraint index value assigned to the control amount value will be with reference to zero or other predetermined finite value. When the second policy is employed, the greater the constraint index value assigned to the control amount value is, the greater the deviation between the target control amount value and the constraint index value can be lead to.

When the second policy is employed, it is preferred that either of the following two methods be used to determine the control amount limitation. A first method is to use a limitation that represents a band in which the integrated constraint index value is smaller than a predetermined threshold value. A second method is to select such a threshold value that a band in which the constraint index value is smaller than the threshold value has a predetermined width, and use a limitation that represents a band defined by the selected threshold value. When the first method is employed, it is preferred that the predetermined threshold value vary with the operating environment of the internal combustion engine. When the second method is employed, it is preferred that the predetermined width vary with the operating environment of the internal combustion engine.

In accomplishing the earlier-mentioned object, according to a second aspect of the present invention, there is provided an internal combustion engine control device that acquires various requests concerning internal combustion engine performance and sets a request-specific constraint for the value of a control amount. More specifically, the control device expresses constraints to be set for control amount values as a set of constraint index values assigned to individual control amount values, and varies the distribution of the constraint index values assigned to the control amount values in accordance with the type of a request. Next, the control device sets a plurality of request groups, each of which includes a plurality of requests. Next, the control device integrates the constraint index value assigned to each request with respect to each control amount value on an individual control amount value basis in each request group, and resets the distribution of the constraint index value in each request group in accordance with the distribution of the integrated constraint index value. Next, the control device integrates the constraint index value assigned to each request group with respect to each control amount value on an individual control amount value basis. Then, in accordance with the distribution of the integrated constraint index value for a control amount, the control device determines a limitation of the control amount, which is defined by an upper-limit value and a lower-limit value. Finally, the control device determines a target control amount value within the range of the determined limitation.

When the above-described process is performed, various requests concerning internal combustion engine performance are converted to a constraint on a control value amount. The various requests are then reflected in a target control amount value through the constraint. In such an instance, the individual requests are grouped into a plurality of request groups, the distribution of the constraint index value is recalculated on an individual request group basis, and the control amount limitation is determined in accordance with the distribution of the constraint index value on such an individual request group basis. Therefore, each request can be hierarchically reflected in the target control amount value.

In the above-described second aspect, the constraint index value to be assigned to each control amount value may be either a discrete value assigned to each of a plurality of bands into which a control amount is divided or a continuous value that is continuous in each control amount value.

As regards the policy to be employed when the constraint index value is to be assigned to each control amount value in the second aspect, the more appropriate the control amount value is for the description of a request, the greater the constraint index value assigned to the control amount value will preferably be with reference to zero or other predetermined finite value. Further, the more inappropriate the control amount value is for the description of a request, the greater the constraint index value assigned to the control amount value will preferably be with reference to zero or other predetermined finite value.

In accomplishing the earlier-mentioned object, according to a third aspect of the present invention, there is provided an internal combustion engine control device that acquires various requests concerning internal combustion engine performance, and sets a plurality of control amount limitations, which are defined by an upper-limit value and a lower-limit value, for individual requests while varying the degree of constraint severity. Next, the control device ultimately determines the control amount limitation in accordance with a limitation overlap between requests and the degree of constraint severity defined by each limitation. Finally, the control device determines a target control amount value within the range of the ultimately determined limitation.

When the above-described process is performed, various requests concerning internal combustion engine performance are converted to a plurality of limitations that differ in the degree of constraint severity. The various requests are then reflected in a target control amount value through constraints defined by such limitations. Therefore, each request need not be expressed in the form of a requested control amount value beforehand. Further, as the final limitation used for determining the target control amount value is determined in accordance with the limitation overlap between requests and with the degree of constraint severity defined by each limitation, all requests including those having relatively low priority are properly reflected in the target control amount value.

In accomplishing the earlier-mentioned object, according to a fourth aspect of the present invention, there is provided an internal combustion engine control device that acquires various requests concerning internal combustion engine performance, and sets a plurality of control amount limitations, which are defined by an upper-limit value and a lower-limit value, for individual requests while varying the degree of constraint severity. Next, the control device sets a plurality of request groups, each of which includes a plurality of requests. Next, the control device integrates a request-specific limitation in each request group and resets a limitation for each request group. Then, in accordance with a limitation overlap between the request groups and with the degree of constraint severity defined by each limitation, the control device ultimately determines the control amount limitation. Finally, the control device determines a target control amount value within the range of the ultimately determined limitation.

When the above-described process is performed, various requests concerning internal combustion engine performance are converted to a plurality of limitations that differ in the degree of constraint severity. The various requests are then reflected in a target control amount value through constraints defined by such limitations. In such an instance, the individual requests are grouped into the plurality of request groups, the limitation is reset for each request group, and a final limitation is determined in accordance with the limitation for each request group. Consequently, each request can be hierarchically reflected in the target control amount value.

BEST MODE FOR CARRYING OUT THE INVENTION

First Embodiment

A first embodiment of the present invention will now be described with reference to FIGS. 1 and 2.

A control device according to the first embodiment is applied to an automotive internal combustion engine (hereinafter referred to as the engine). The type of an applicable engine is not limited. The control device can be applied to various types of engines, including a spark ignition engine, a compression ignition engine, a four-stroke engine, a two-stroke engine, a reciprocating engine, a rotary engine, a single-cylinder engine, and a multi-cylinder engine. The control device according to the present embodiment controls one or more actuators provided for such an engine, such as a throttle and an ignition device, in accordance with an engine control amount, such as a target torque value.

Figure 1:
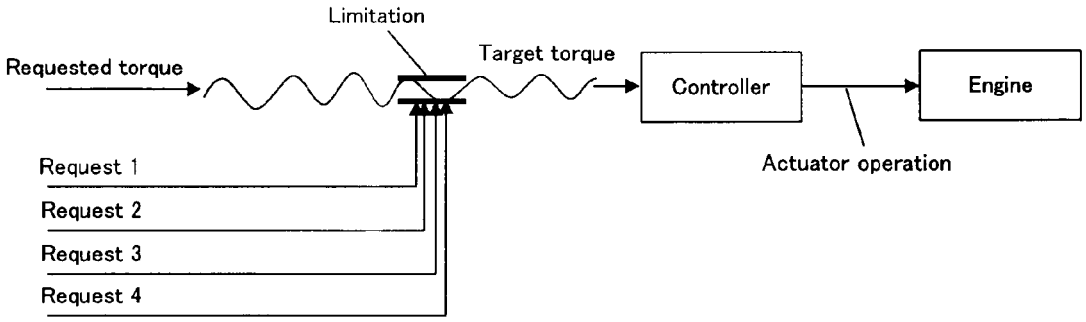
FIG. 1 is a block diagram illustrating a configuration of a control device according to a first embodiment of the present invention.

FIG. 1 is a block diagram illustrating the configuration of the control device according to the present embodiment. A requested torque value (hereinafter referred to as the requested torque), which is an engine control amount, is supplied to the control device. It can be interpreted that the requested torque is obtained when a request concerning drivability, which is one of engine performance characteristics, is expressed in the form of torque which is one of engine control amounts. In addition, various other requests concerning engine performance, such as a request concerning emissions performance and a request concerning a fuel consumption rate, are supplied to the control device. These requests are supplied from a higher-level control device that provides overall control of a vehicle. The control device according to the present embodiment determines a target torque value (hereinafter referred to as the target torque) on the basis of the supplied requested torque. In accordance with the determined target torque, the control device operates various torque-related actuators in such a manner as to control the torque of the engine.

Various engine performance requests supplied to the control device with the requested torque are considered when the target torque is determined from the requested torque. As shown in FIG. 1, such requests are converted to a limitation imposed on torque, which is defined by an upper-limit value and a lower-limit value, and reflected in the target torque through constraints based on the limitation. It should be noted that only one limitation is used to determine the target torque although a plurality of requests are supplied. It means that all requests are reflected in this one limitation. A method of determining a torque limitation from various engine performance requests will be described in detail below.

Figure 2:
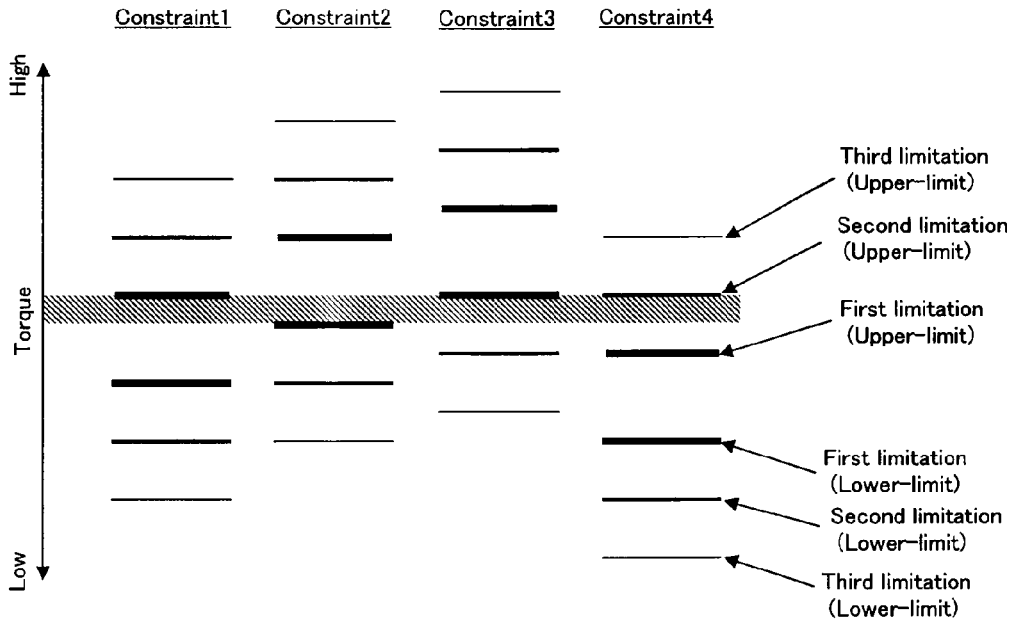
FIG. 2 is a diagram illustrating a limitation determination method employed in the first embodiment of the present invention.

FIG. 2 is a diagram illustrating a limitation determination method employed in the present embodiment. In FIG. 2, the vertical axis represents a torque value and a large number of horizontal lines represent a torque limitation. FIG. 2 shows four constraints: Constraint 1, Constraint 2, Constraint 3, and Constraint 4. These constraints are obtained by converting different types of requests. In other words, one constraint is obtained from one request.

Each constraint includes a plurality of limitations (three limitations in FIG. 2). Each limitation includes a pair of upper- and lower-limit values. In FIG. 2, each pair of upper- and lower-limit values can be easily identified because the horizontal lines indicative of limit values vary in thickness from one limitation to another. The thickest horizontal lines indicate the upper- and lower-limit values of a first limitation. The second thickest horizontal lines indicate the upper- and lower-limit values of a second limitation. The thinnest horizontal lines indicate the upper- and lower-limit values of a third limitation. As is obvious from the range of each limitation, the severest restriction is imposed by the first limitation; the second severest restriction is imposed by the second limitation; and the loosest restriction is imposed by the third limitation.

As indicated in FIG. 2, the limitation setting varies from one constraint to another, that is, from one request to another. The reason is that the permissible range of torque varies with the type of a request. For example, a comparison between Constraint 1 and Constraint 4 shows that Constraint 4 has a lower limitation setting than Constraint 1. It means that the torque permitted by a request on which Constraint 4 is based is lower than the torque permitted by a request on which Constraint 1 is based.

As shown in FIG. 2, if the limitation varies from one constraint to another, the problem is how to define the final limitation. If the relationship between a certain constraint and the target torque is such that the target torque is within the range of a relatively severe limitation, the level of satisfaction of a request on which the constraint is based is high. If, on the contrary, the target torque is within only the range of a loose limitation, the level of satisfaction of a request on which the constraint is based is low. Therefore, it is most desirable for all constraints that the target torque be within the range of the severest limitation. However, as is obvious from the example shown in FIG. 2, when a set of the severest limitations (the first limitations) of individual constraints is obtained, it is easily conceivable that the set is empty.

In the present embodiment, each constraint includes a plurality of limitations differing in severity in order to avoid the above-mentioned empty set and make all requests be reflected in the target torque setting. Even if the target torque for a certain constraint is outside the range of the first limitation, which is the severest, a request on which the constraint is based can be satisfied to a certain extent as far as the target torque is within the range of the second limitation, which is the second severest. Further, if the target torque for most of the other constraints turns out to be within the range of the first limitation, which is the severest, an overall request concerning the entire engine is satisfied to a great extent. In the example shown in FIG. 2, the range of torque (a hatched portion in FIG. 2) included within the ranges of the first limitations imposed by Constraints 1, 2, and 3 and within the range of the second limitation imposed by Constraint 4 is set as the final limitation. The target torque is then set within the range of the final limitation.

As described above, the present embodiment converts various requests concerning engine performance to a plurality of limitations differing in constraint severity and makes the requests be reflected in the target torque setting through the constraints based on the limitations. Therefore, each request need not be expressed beforehand in the form of a requested control amount value. Further, as the final limitation used for determining the target torque is determined in accordance with the limitation overlap between requests and with the degree of constraint severity defined by each limitation, all requests including those having relatively low priority are properly reflected in the target torque.

In the example shown in FIG. 2, the width of the range of each limitation does not vary from one constraint to another. Alternatively, however, the width of the range of each limitation may be set to vary from one constraint to another, namely, from one request to another. For example, an alternative would be to narrow the range of the first limitation for Constraint 2 only or widen the range of the third limitation. Further, the range of the first limitation may be narrowed by changing both the upper- and lower-limit values or by changing either the upper-limit value or the lower-limit value. The width of the range of each limitation and the upper- and lower-limit values of each limitation can be determined in accordance with the type and description of a request.

In the example shown in FIG. 2, three limitations are provided. Alternatively, however, a larger number of limitations may be provided. From the viewpoint of the present invention, a plurality of limitations should be provided. Therefore, the use of only the first and second limitations is acceptable. Another alternative is to vary the number of limitations from one constraint to another, namely, from one request to another. For example, the number of limitations provided for only Constraint 2 may be decreased to two or increased to four. The number of limitations can be determined in accordance with the type and description of a request.

Second Embodiment

A second embodiment of the present invention will now be described with reference to FIGS. 3 and 4.

The control device according to the second embodiment has the same configuration as the control device according to the first embodiment whose configuration is shown in the block diagram of FIG. 1. The second embodiment differs from the first embodiment in the method of determining the torque limitation used for target torque determination. This is also true for the other embodiments, which will be described later. Each embodiment is characterized by its method of determining the torque limitation from various requests concerning engine performance.

Figure 3:
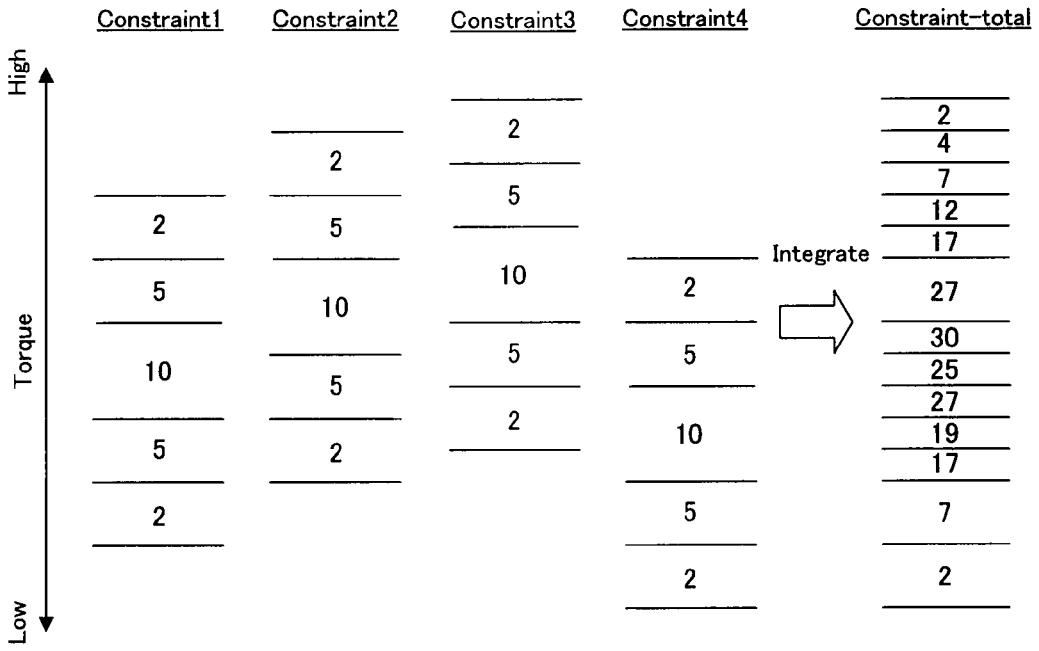
FIG. 3 is a diagram illustrating a limitation determination method employed in a second embodiment of the present invention.

FIG. 3 is a diagram illustrating a limitation determination method employed in the second embodiment. Although four constraints (Constrains 1, 2, 3, and 4) are shown in FIG. 3, as is the case with the first embodiment, they are different from those used in the first embodiment. In the second embodiment, each constraint is expressed as a set of constraint index values assigned to individual torque values which are control amounts. More specifically, each constraint is configured so that a torque region is divided into a plurality of bands (five bands in FIG. 3). The constraint index value assigned to a central band is 10. The constraint index values assigned to the bands adjacent to the central band are 5. The constraint index values assigned to the outmost bands are 2. In the present embodiment, the constraint index values are set with reference to zero. The greater the constraint index values, the more appropriate for the description of a request the associated torque value will be. Further, the position of each band on a torque axis varies from one constraint to another, namely, from one request to another. It means that band setup is performed in accordance with the type of a request.

The control device according to the present embodiment integrates the constraint index values assigned to individual constraints, namely, to individual requests for each torque value. As a result, a distribution of integrated constraint index values, which is named "Constraint-total", is obtained as indicated at the rightmost end of FIG. 3. The appropriateness of a torque value to which an integrated constraint index value is assigned increases with an increase in the integrated constraint index value to wholly satisfy individual requests. In other words, the integrated constraint index value is an index value for quantitatively evaluating the level of satisfaction of each torque value with the entire request. Therefore, when the maximum value of the integrated constraint index value is given to a certain band, the band is the most appropriate band for target torque setup, that is, a torque limitation for target torque setup. According to the distribution of integrated constraint index values shown in FIG. 3, the maximum value of the integrated constraint index values is 30. Thus, the band to which the maximum value of 30 is assigned is set as the torque limitation. The target torque is then set within the range of the torque limitation.

As described above, the present embodiment converts various requests concerning engine performance to a constraint on a torque value and makes the requests be reflected in the target torque setting through the constraint. Therefore, each request need not be expressed beforehand in the form of a requested control amount value. Further, the integrated constraint index value makes it possible to quantitatively evaluate the level of satisfaction of each torque value with the entire request. Therefore, when the target torque is determined in accordance with the distribution of the integrated constraint index value, all requests including those having relatively low priority are properly reflected in the target torque.

Figure 4:
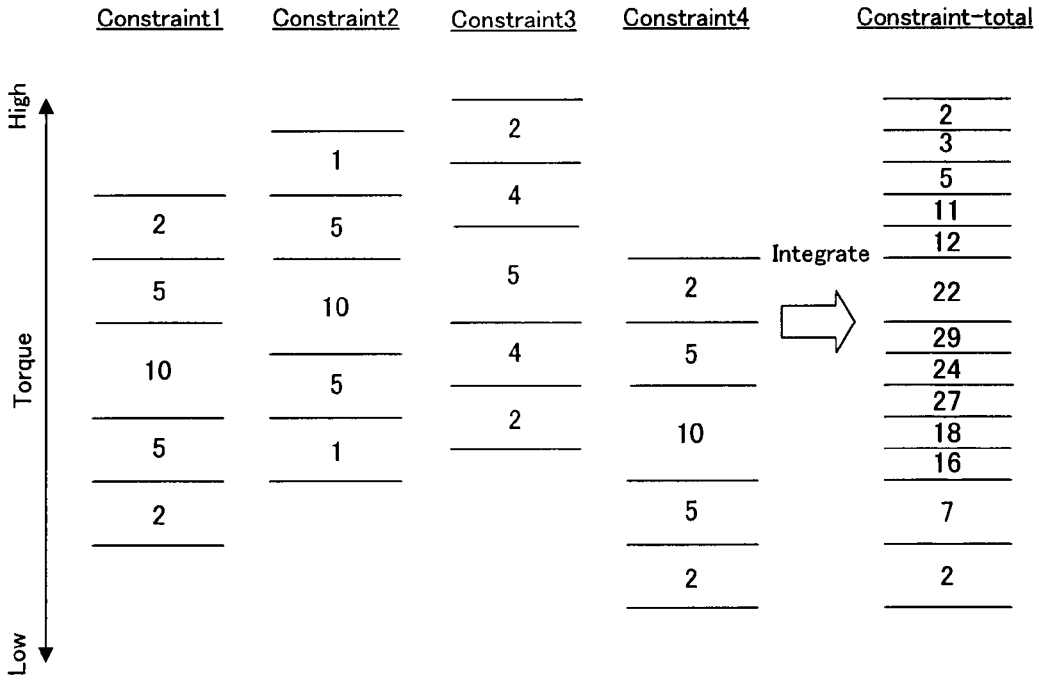
FIG. 4 is a diagram illustrating the limitation determination method employed in the second embodiment of the present invention.

Meanwhile, as shown in FIG. 4, the constraint index value to be assigned to each band can be set to vary from one constraint to another, namely, from one request to another. When the constraint index value to be assigned to each band is variable, the greater the constraint index value assigned to a certain band is, the smaller the deviation between the target torque and a torque value within the band can be lead to. Conversely, the smaller the constraint index value assigned to a certain band is, the greater the deviation between the target torque and a torque value within the band can be lead to. Therefore, when the constraint index value to be assigned to each band varies with the type and description of a request, the degree of reflection of each request in the target torque can be fine-tuned.

In the examples shown in FIGS. 3 and 4, the width of each band does not vary from one constraint to another. Alternatively, however, the width of each band may be set to vary from one constraint to another, namely, from one request to another. In the example shown in FIG. 3, for example, an alternative would be to narrow the central band (a band having a constraint index value of 10) of Constraint 2 only or make the upper one of the bands (bands having a constraint index value of 5) adjacent to the central band narrower than the lower one. The width of each band as well as the constraint index value to be assigned to each band can be set in accordance with the type and description of a request.

Third Embodiment

A third embodiment of the present invention will now be described with reference to FIGS. 5 and 6.

Figure 5:
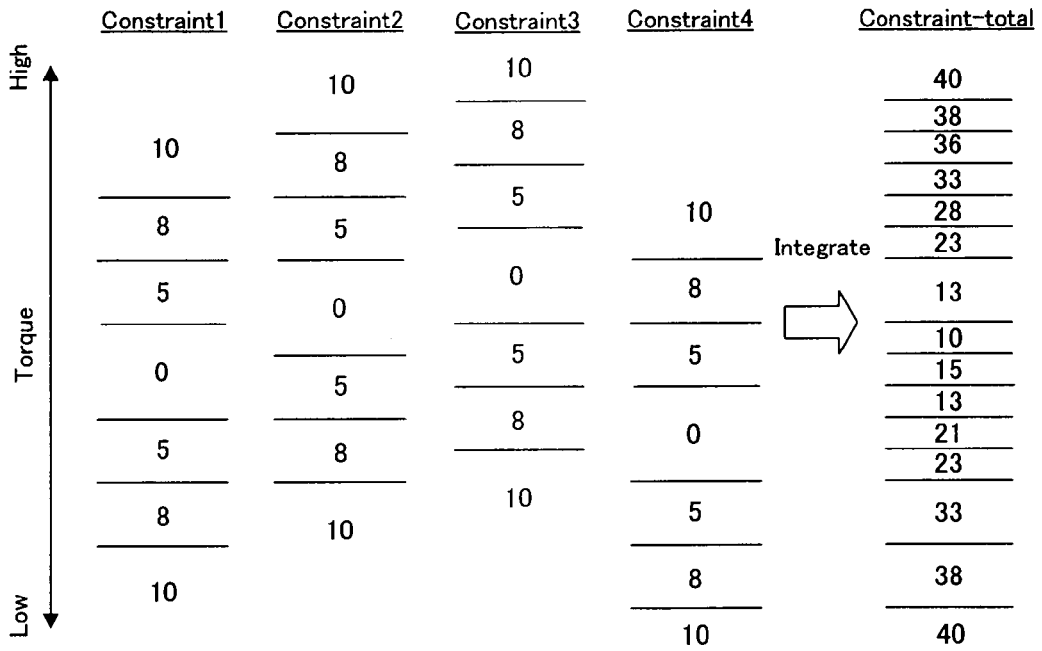
FIG. 5 is a diagram illustrating a method for determining a limitation of a control amount according to a third embodiment of the present invention.

FIG. 5 is a diagram illustrating a limitation determination method employed in the third embodiment. As is the case with the second embodiment, the third embodiment is configured so that the torque regions of the individual constraints (Constraints 1, 2, 3, and 4) are divided into a plurality of bands with a constraint index value assigned to each band. However, the third embodiment differs from the second embodiment in the policy of assigning the constraint index value to each band. In the third embodiment, the constraint index value is set with reference to zero. The greater the constraint index value is, the more inappropriate for the description of a request the associated torque value will be. In the example shown in FIG. 5, the assigned constraint index value, which does not vary from one constraint to another, is 0 for the central band, 5 for the bands adjacent to the central band, and 8 for the outer bands. Further, the constraint index value assigned to the outermost bands is 10. It should be noted that the position of each band on the torque axis varies from one constraint to another, namely, from one request to another. It means that band setup is performed in accordance with the type of a request.

"Constraint-total", which is indicated at the rightmost end of FIG. 5, represents a distribution of the integrated constraint index value that is obtained when constraint index values are integrated on an individual torque value basis. Contrary to the integrated constraint index value according to the second embodiment, the integrated constraint index value according to the third embodiment is such that the appropriateness of a torque value to which the integrated constraint index value is assigned increases with a decrease in the integrated constraint index value to wholly satisfy individual requests. Therefore, when the minimum value of the integrated constraint index value is given to a certain band, the band is the most appropriate band for target torque setup, that is, a torque limitation for target torque setup. According to the distribution of integrated constraint index values shown in FIG. 5, the minimum value of the integrated constraint index values is 10. Thus, the band to which the minimum value of 10 is assigned is set as the torque limitation. The target torque is then set within the range of the torque limitation.

The constraint index value to be assigned to each band may be set to vary from one constraint to another. One example is shown in FIG. 6. When the constraint index value to be assigned to each band is variable, the greater the constraint index value assigned to a certain band is, the greater the deviation between the target torque and a torque value within the band can be lead to. Conversely, the smaller the constraint index value assigned to a certain band is, the smaller the deviation between the target torque and a torque value within the band can be lead to. Therefore, when the constraint index value to be assigned to each band varies with the type and description of a request, the degree of reflection of each request in the target torque can be fine-tuned.

Figure 6:
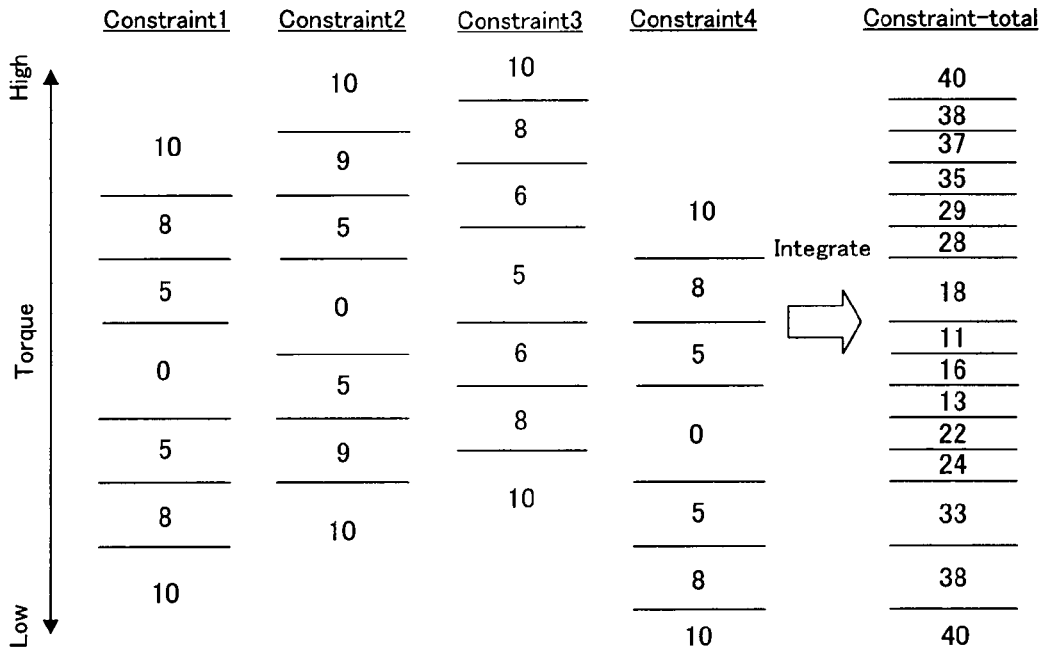
FIG. 6 is a diagram illustrating the limitation determination method employed in the third embodiment of the present invention.

In the examples shown in FIGS. 5 and 6, the width of each band does not vary from one constraint to another. Alternatively, however, the width of each band may also be set to vary from one constraint to another (from one request to another) in the present embodiment. The width of each band as well as the constraint index value to be assigned to each band can be set in accordance with the type and description of a request.

Fourth Embodiment

A fourth embodiment of the present invention will now be described with reference to FIGS. 7 to 9.

Figure 7:
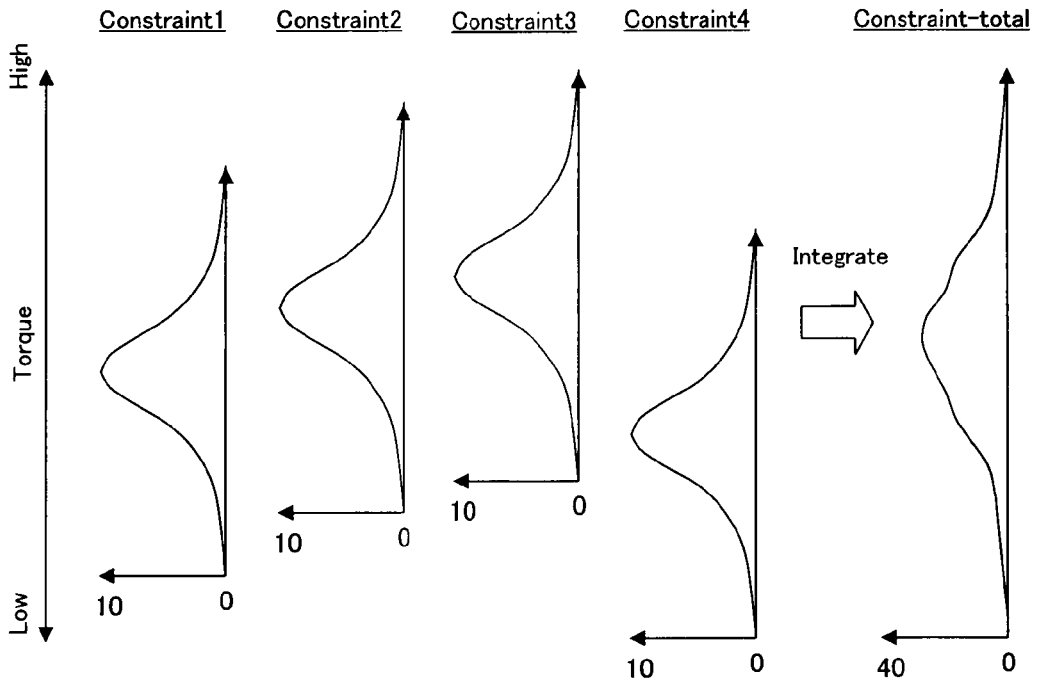
FIG. 7 is a diagram illustrating a limitation determination method employed in a fourth embodiment of the present invention.

FIG. 7 is a diagram illustrating a limitation determination method employed in the fourth embodiment. As is the case with the second embodiment, the fourth embodiment is configured so that the individual constraints (Constraints 1, 2, 3, and 4) are expressed as a set of constraint index values assigned to individual torque values which are control amounts. However, although the constraint index value in the second embodiment is a discrete value assigned to each of a plurality of bands into which the torque region is divided, the constraint index value in the fourth embodiment is a continuous value that is continuous in each torque value. In the fourth embodiment, the constraint index value is set with reference to zero. The greater the constraint index value, the more appropriate for the description of a request the associated torque value will be.

"Constraint-total", which is indicated at the rightmost end of FIG. 7, represents a distribution of the integrated constraint index value that is obtained when constraint index values are integrated on an individual torque value basis. As is the case with the integrated constraint index value according to the second embodiment, the integrated constraint index value according to the fourth embodiment is such that the appropriateness of a torque value to which the integrated constraint index value is assigned increases with an increase in the integrated constraint index value to wholly satisfy individual requests. Therefore, a torque value providing the maximum value of the integrated constraint index value can be regarded as the most appropriate torque value for target torque setup. However, the integrated constraint index value is nothing but an index value for ensuring that various requests other than a requested torque are reflected in the target torque setting. Ultimately, therefore, the target torque needs to be determined in consideration of the requested torque. To determine the target torque in such a manner, it is necessary to make a target torque selection from a band having an adequate width. The band having an adequate width is a torque limitation defined by an upper-limit value and a lower-limit value.

Figure 8:
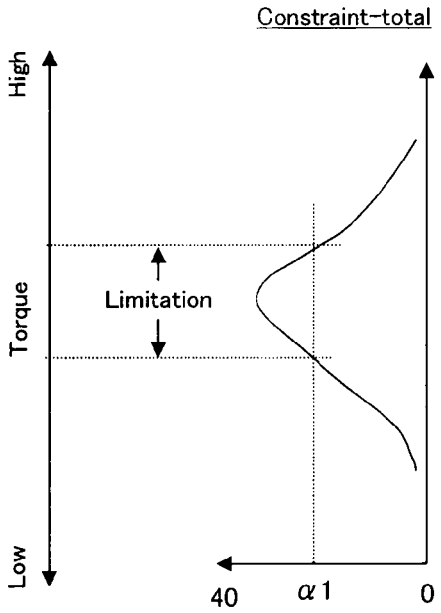
FIG. 8 is a diagram illustrating the limitation determination method employed in the fourth embodiment of the present invention.
Figure 9:
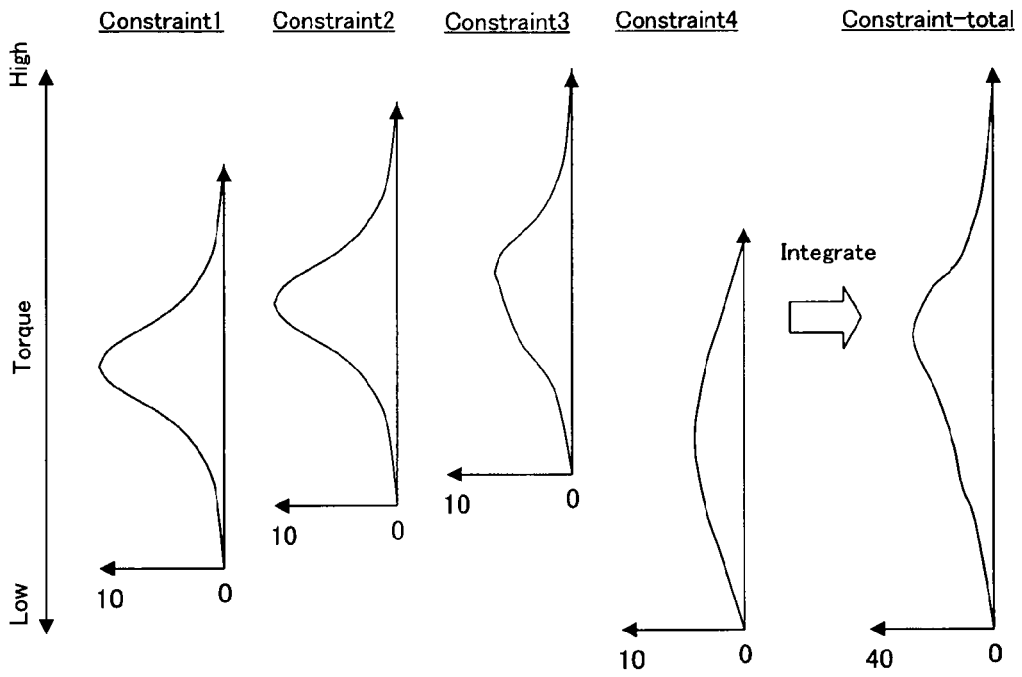
FIG. 9 is a diagram illustrating the limitation determination method employed in the fourth embodiment of the present invention.

In the present embodiment, a band in which the integrated constraint index value is greater than a predetermined threshold value $\alpha 1$ is set as the torque limitation, as shown in FIG. 8. The target torque is set within the range of the torque limitation. The threshold value $\alpha 1$ may be either fixed or varied in accordance with the operating environment of the engine.

The constraint index value to be assigned to each torque value may be set to vary from one constraint to another. In other words, the shape of the distribution of the constraint index values for the torque values may be set to vary from one constraint to another. One example is shown in FIG. 9. When the constraint index value to be assigned to each torque value is variable, the greater the constraint index value assigned to a torque value is, the smaller the deviation between the torque value and the target torque can be lead to. Conversely, the smaller the constraint index value assigned to a certain torque value is, the greater the deviation between the torque value and the target torque can be lead to. Therefore, when the shape of the distribution of the constraint index values varies with the type and description of a request, the degree of reflection of each request in the target torque can be fine-tuned.

Fifth Embodiment

Figure 10:
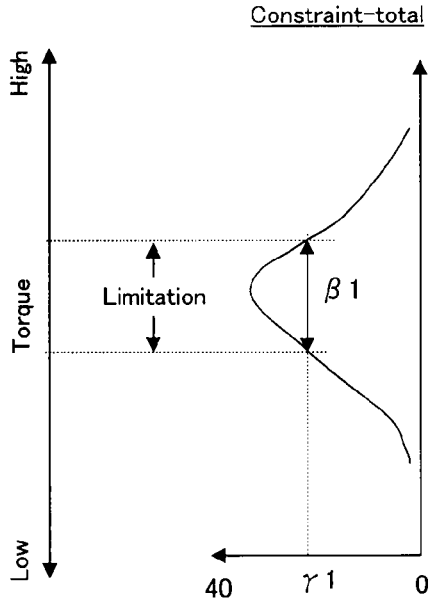
FIG. 10 is a diagram illustrating a limitation determination method employed in a fifth embodiment of the present invention.

A fifth embodiment of the present invention will now be described with reference to FIG. 10.

The fifth embodiment is based on the fourth embodiment. The fifth embodiment differs from the fourth embodiment in the method of determining the torque limitation from the distribution of the integrated constraint index value. As shown in FIG. 10, the fifth embodiment first selects a threshold value $\gamma 1$ so that a band in which the constraint index value exceeds the threshold value has a predetermined width $\beta 1$. The band defined by the threshold value $\gamma 1$ is then set as the limitation. More specifically, the fourth embodiment varies the bandwidth of the limitation in accordance with the shape of the distribution of the integrated constraint index value, whereas the fifth embodiment constantly obtains a limitation having the fixed bandwidth $\beta 1$. The bandwidth $\beta 1$ of the limitation may be either fixed or varied in accordance with the operating environment of the engine.

Sixth Embodiment

A sixth embodiment of the present invention will now be described with reference to FIGS. 11 to 13.

Figure 11:
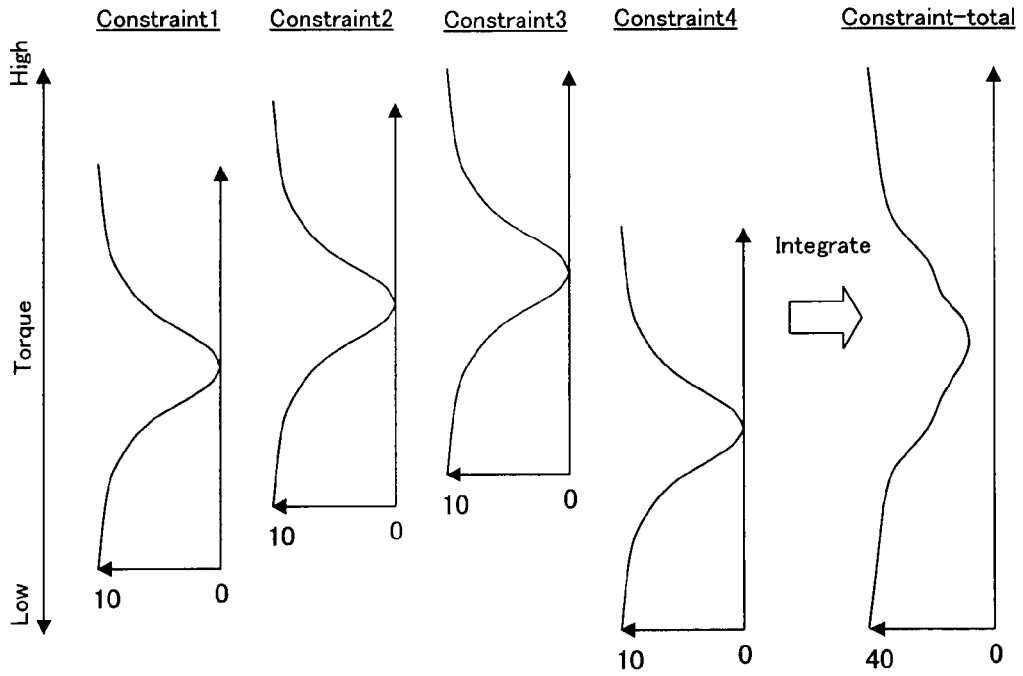
FIG. 11 is a diagram illustrating a limitation determination method employed in a sixth embodiment of the present invention.

FIG. 11 is a diagram illustrating a limitation determination method employed in the sixth embodiment. As is the case with the fourth embodiment, the sixth embodiment is configured so that the individual constraints (Constraints 1, 2, 3, and 4) are expressed as a set of constraint index values assigned to individual torque values which are control amounts. The constraint index values are a continuous value that is continuous in each torque value. However, the sixth embodiment differs from the fourth embodiment in the policy of assigning the constraint index value to each band. In the sixth embodiment, the constraint index value is set with reference to zero. The greater the constraint index value, the more inappropriate for the description of a request the associated torque value will be. Therefore, the shape of the distribution of the constraint index values for the torque values of the individual constraints is substantially a left-right reversal of the shape of the distribution in the fourth embodiment.

"Constraint-total", which is indicated at the rightmost end of FIG. 11, represents a distribution of the integrated constraint index value that is obtained when constraint index values are integrated on an individual torque value basis. Contrary to the integrated constraint index value according to the fourth embodiment, the integrated constraint index value according to the sixth embodiment is such that the appropriateness of a torque value to which the integrated constraint index value is assigned increases with a decrease in the integrated constraint index value to wholly satisfy individual requests. Therefore, a torque value providing the minimum value of the integrated constraint index value can be regarded as the most appropriate torque value for target torque setup. However, for the same reason as described in connection with the fourth embodiment, it is necessary to make a target torque selection from a band having an adequate width. The band having an adequate width is a torque limitation defined by an upper-limit value and a lower-limit value.

Figure 12:
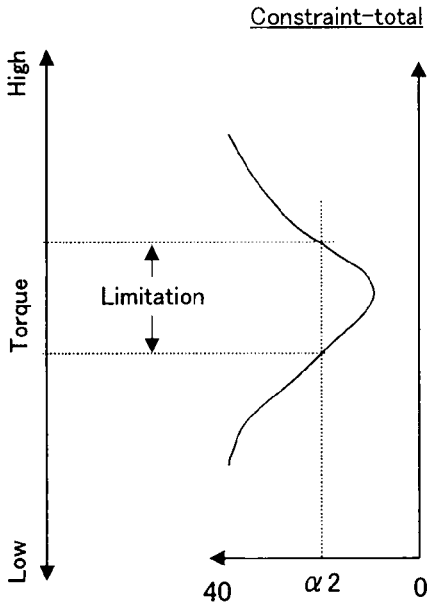
FIG. 12 is a diagram illustrating the limitation determination method employed in the sixth embodiment of the present invention.
Figure 13:
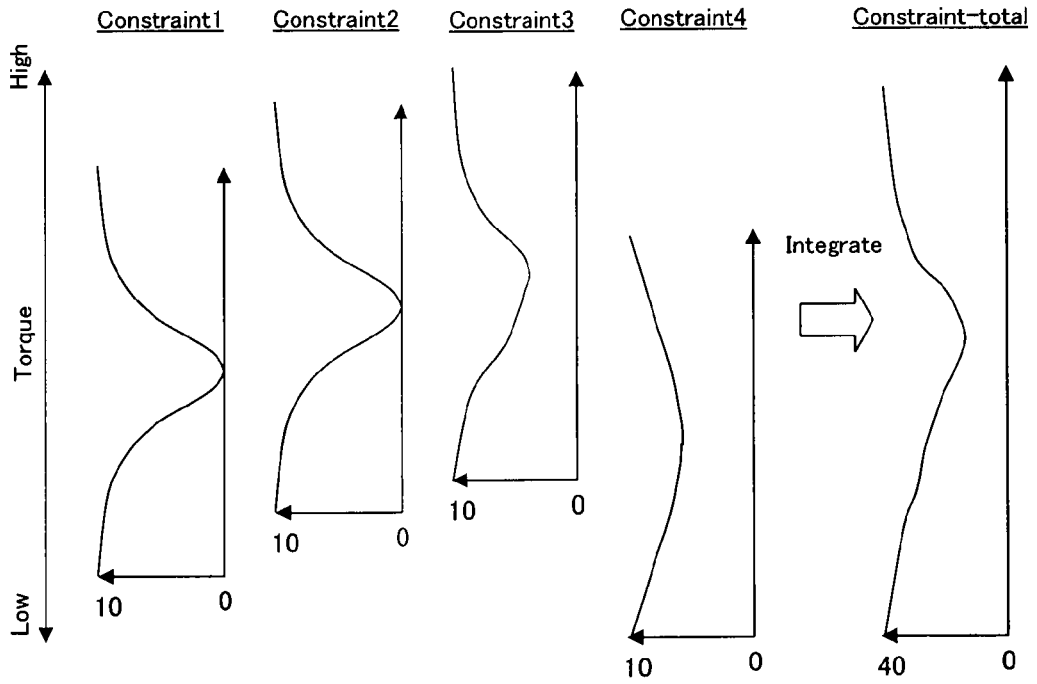
FIG. 13 is a diagram illustrating the limitation determination method employed in the sixth embodiment of the present invention.

In the sixth embodiment, a band in which the integrated constraint index value is smaller than a predetermined threshold value $\alpha 2$ is set as the torque limitation, as shown in FIG. 12. The target torque is set within the range of the torque limitation. The threshold value $\alpha 2$ may be either fixed or varied in accordance with the operating environment of the engine.

The shape of the distribution of the constraint index values for the torque values may be set to vary from one constraint to another. One example is shown in FIG. 13. When the constraint index value to be assigned to each torque value is variable, the greater the constraint index value assigned to a torque value is, the greater the deviation between the torque value and the target torque can be lead to. Conversely, the smaller the constraint index value assigned to a certain torque value is, the smaller the deviation between the torque value and the target torque can be lead to. Therefore, when the shape of the distribution of the constraint index values varies with the type and description of a request, the degree of reflection of each request in the target torque can be fine-tuned.

Seventh Embodiment

Figure 14:
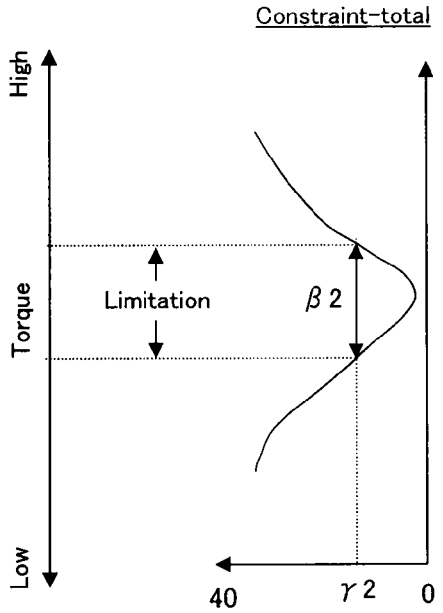
FIG. 14 is a diagram illustrating a limitation determination method employed in a seventh embodiment of the present invention.

A seventh embodiment of the present invention will now be described with reference to FIG. 14.

The seventh embodiment is based on the sixth embodiment. The seventh embodiment differs from the sixth embodiment in the method of determining the torque limitation from the distribution of the integrated constraint index value. As shown in FIG. 14, the seventh embodiment first selects a threshold value $\gamma 2$ so that a band in which the constraint index value is smaller than the threshold value has a predetermined width $\beta 2$. The band defined by the threshold value $\gamma 2$ is then set as the limitation. More specifically, the sixth embodiment varies the bandwidth of the limitation in accordance with the shape of the distribution of the integrated constraint index value, whereas the seventh embodiment constantly obtains a limitation having the fixed bandwidth $\beta 2$. The bandwidth $\beta 2$ of the limitation may be either fixed or varied in accordance with the operating environment of the engine.

Eighth Embodiment

Figure 15:
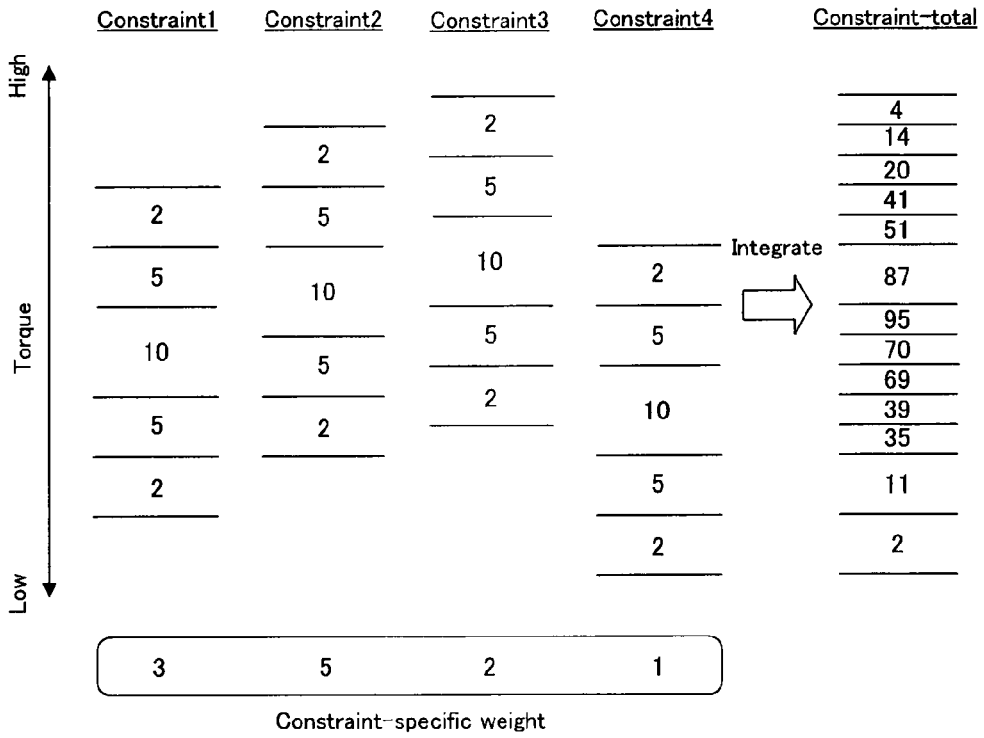
FIG. 15 is a diagram illustrating a limitation determination method employed in an eighth embodiment of the present invention.

An eighth embodiment of the present invention will now be described with reference to FIG. 15.

The eighth embodiment is based on the second embodiment and is characterized in that the constraints, namely, the requests, are variously weighted. In the example shown in FIG. 15, a weight of 3 is applied to Constraint 1; a weight of 5 is applied to Constraint 2; a weight of 2 is applied to Constraint 3; and a weight of 1 is applied to Constraint 4. As the weight to be applied to each request is variable, each request is weighted according to its importance. The example shown in FIG. 15 indicates that a request related to Constraint 2, which has a weight of 5, is the most important, and that a request related to Constraint 4, which has a weight of 1, is relatively unimportant.

The control device according to the eighth embodiment multiplies the constraint index value assigned to each band by the weight, which varies from one constraint to another, and integrates the resulting values for each torque value. As a result, a distribution of integrated constraint index values, which is named "Constraint-total", is obtained as indicated at the rightmost end of FIG. 15. According to the distribution of the integrated constraint index values, which is shown in FIG. 15, the maximum value of the integrated constraint index values is 95. Thus, the band to which the maximum value of 95 is assigned is set as the torque limitation. When the target torque is set within the range of the torque limitation, the importance of each request can be reflected in the target torque setting.

Ninth Embodiment

Figure 16:
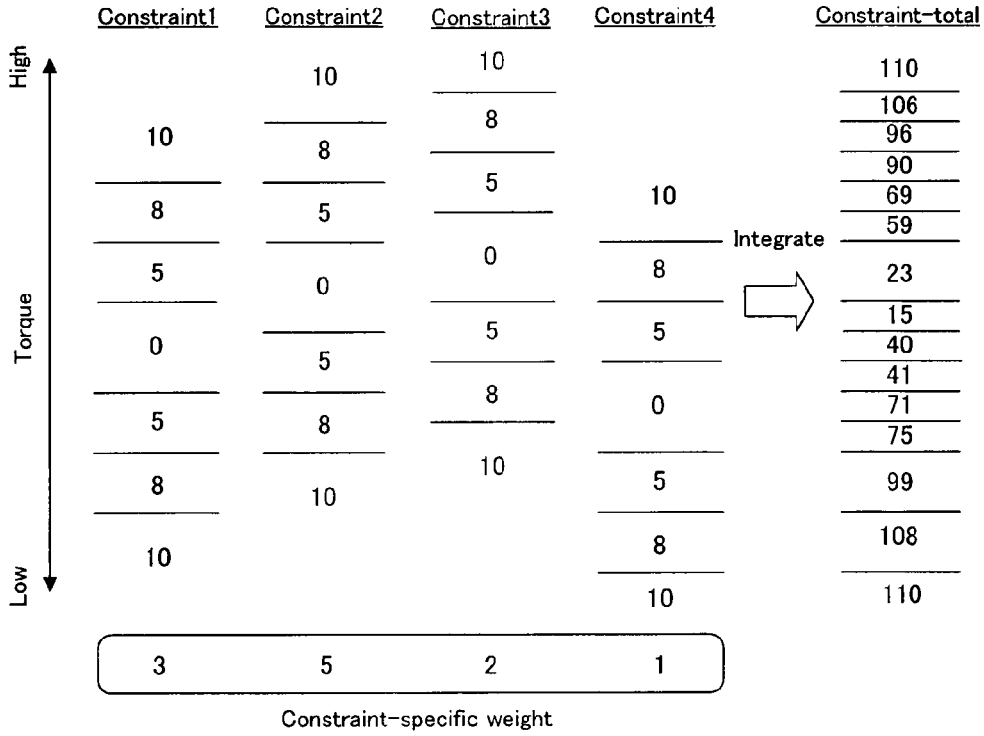
FIG. 16 is a diagram illustrating a limitation determination method employed in a ninth embodiment of the present invention.

A ninth embodiment of the present invention will now be described with reference to FIG. 16.

The ninth embodiment is based on the third embodiment and is characterized in that the constraints, namely, the requests, are variously weighted. As is the case with the eighth embodiment, the weight to be applied to each request is variable and each request is weighted according to its importance. "Constraint-total", which is indicated at the rightmost end of FIG. 16, represents a distribution of the integrated constraint index values that are obtained when the constraint index values assigned to the individual bands are weighted in a manner that varies from one constraint to another, and integrated on an individual torque value basis. According to the distribution of the integrated constraint index values shown in FIG. 16, the minimum value of the integrated constraint index values is 15. Thus, the band to which the minimum value of 15 is assigned is set as the torque limitation. The ninth embodiment not only provides the advantages of the third embodiment, but also makes it possible to cause the importance of each request to be reflected in the target torque setting.

Tenth Embodiment

Figure 17:
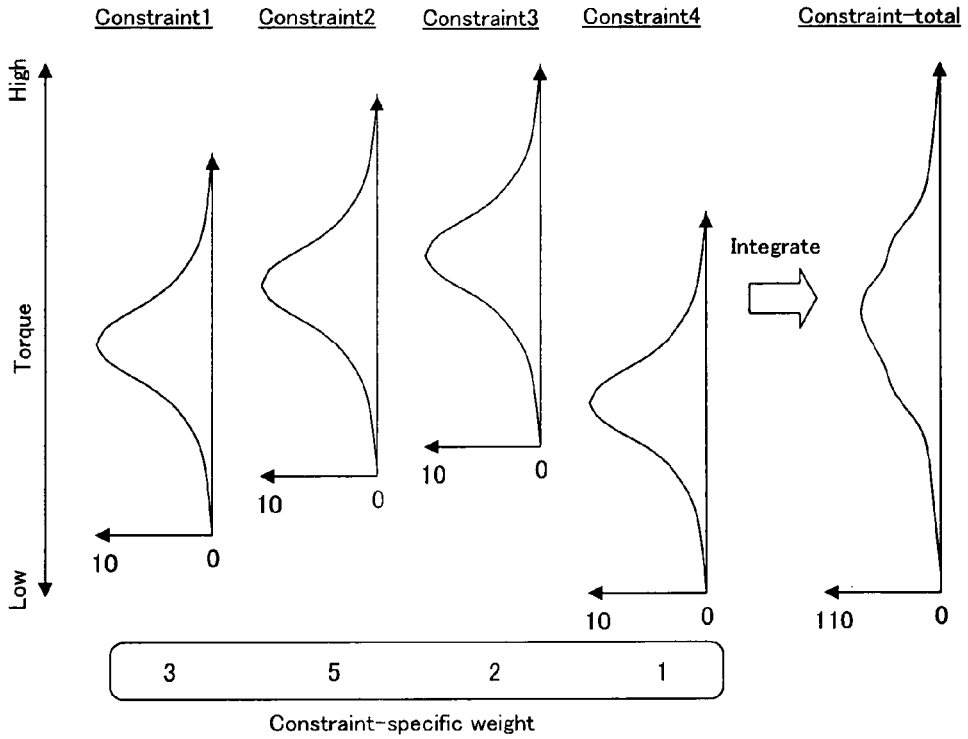
FIG. 17 is a diagram illustrating a limitation determination method employed in a tenth embodiment of the present invention.

A tenth embodiment of the present invention will now be described with reference to FIG. 17.

The tenth embodiment is based on the fourth embodiment and is characterized in that the constraints, namely, the requests, are variously weighted. As is the case with the eighth and ninth embodiments, the weight to be applied to each request is variable and each request is weighted according to its importance. "Constraint-total", which is indicated at the rightmost end of FIG. 17, represents a distribution of the integrated constraint index values that are obtained when the constraint index values assigned to the individual torque values are weighted in a manner that varies from one constraint to another, and integrated on an individual torque value basis. From this distribution of the integrated constraint index values, the torque limitation is determined by using a method described in connection with the fourth or fifth embodiment. The tenth embodiment not only provides the advantages of the fourth embodiment, but also makes it possible to cause the importance of each request to be reflected in the target torque setting.

Eleventh Embodiment

Figure 18:
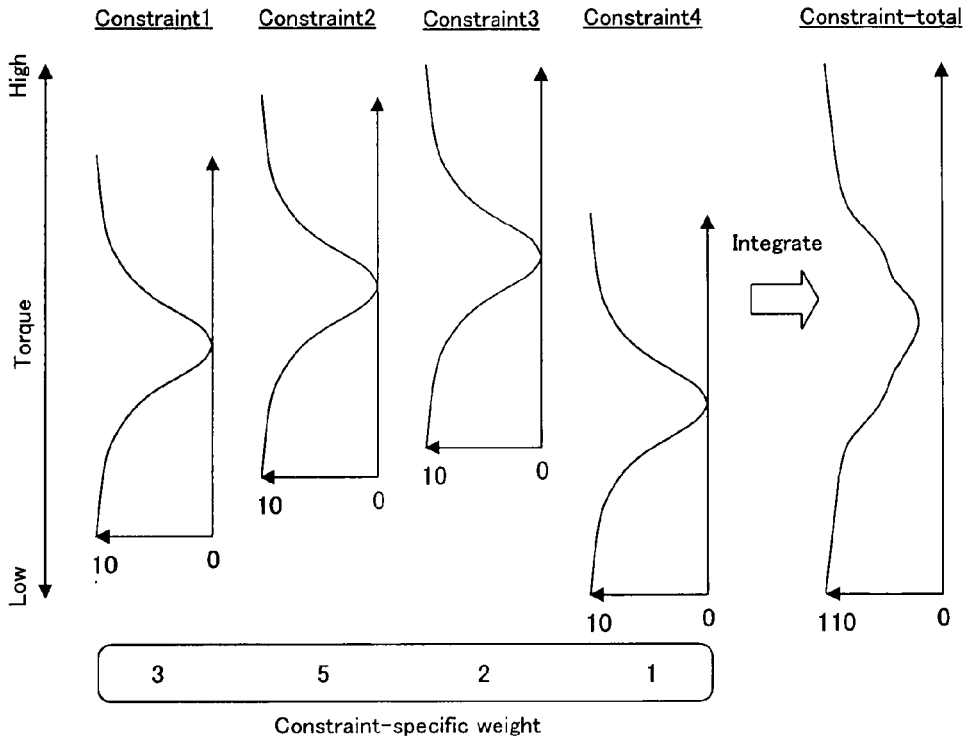
FIG. 18 is a diagram illustrating a limitation determination method employed in an eleventh embodiment of the present invention.

An eleventh embodiment of the present invention will now be described with reference to FIG. 18.

The eleventh embodiment is based on the sixth embodiment and is characterized in that the constraints, namely, the requests, are variously weighted. As is the case with the eighth to tenth embodiments, the weight to be applied to each request is variable and each request is weighted according to its importance. "Constraint-total", which is indicated at the rightmost end of FIG. 18, represents a distribution of the integrated constraint index values that are obtained when the constraint index values assigned to the individual torque values are weighted in a manner that varies from one constraint to another, and integrated on an individual torque value basis. From this distribution of the integrated constraint index values, the torque limitation is determined by using a method described in connection with the sixth or seventh embodiment. The eleventh embodiment not only provides the advantages of the sixth embodiment, but also makes it possible to cause the importance of each request to be reflected in the target torque setting.

Twelfth Embodiment

A twelfth embodiment of the present invention will now be described with reference to FIGS. 19 and 20.

The twelfth embodiment is based on the first embodiment and is characterized in that a request group into which a plurality of requests are grouped is formed to reset the limitation on the request group by integrating request-specific limitations within the request group. In the example shown in FIG. 19, Constraints 1, 2, 3, and 4 belong to a request group, and the result of integration of Constraints 1, 2, 3, and 4 is depicted as Constraint X. Constraint X, which is a constraint of the request group, includes three limitations, as is the case with request-specific constraints. A first limitation, which represents the severest restriction, is a range within which the first limitation of each request can be met wherever possible. A second limitation, which represents the second severest restriction, is a range within which the second limitation of each request can be met wherever possible. A third limitation, which represents the loosest restriction, is a range within which the third limitation of each request can be met wherever possible.

Figure 19:
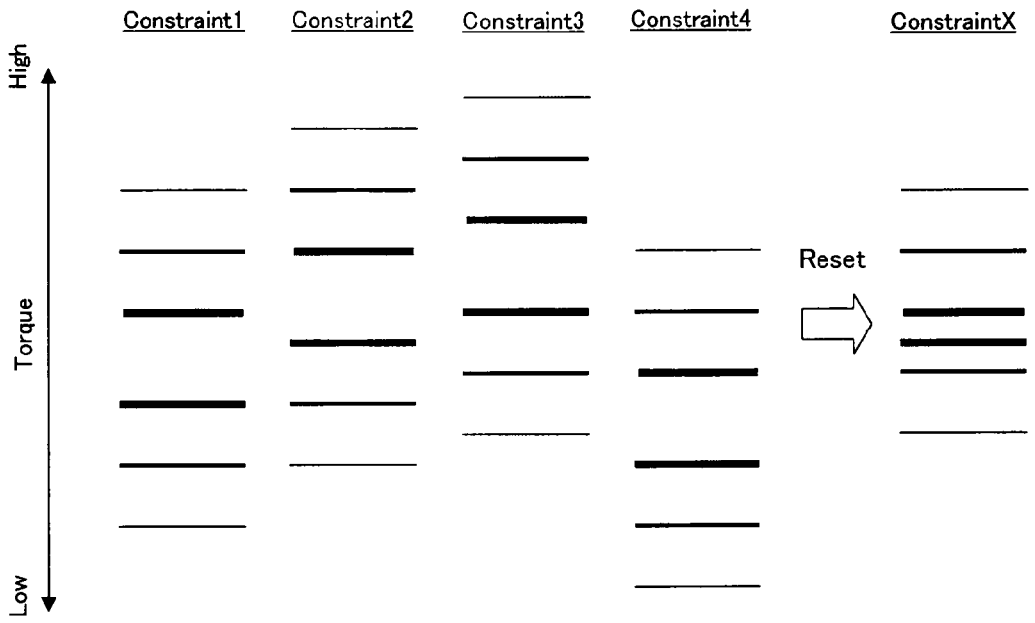
FIG. 19 is a diagram illustrating a limitation determination method employed in a twelfth embodiment of the present invention.
Figure 20:
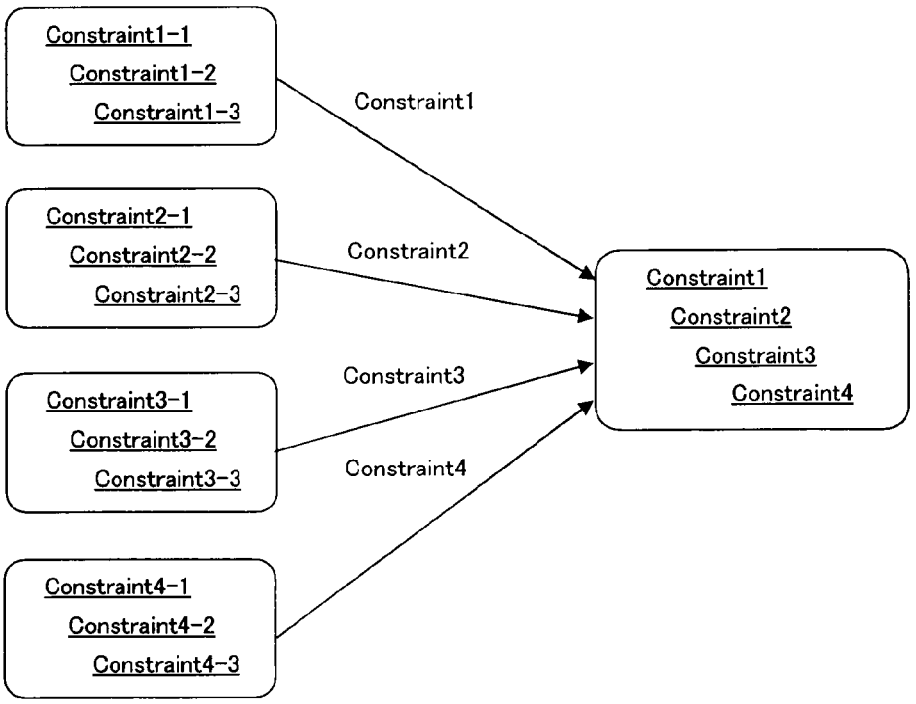
FIG. 20 is a diagram illustrating the limitation determination method employed in the twelfth embodiment of the present invention.

The control device according to the twelfth embodiment additionally performs the above-described process on the other requests to set a plurality of request-group-specific limitations as indicated in FIG. 19. In such an instance, it is preferred that requests forming a group be similar to each other in type and description. The torque limitation is then ultimately determined in accordance with the limitation overlap between request groups and with the degree of constraint severity defined by each limitation. As a result, a hierarchical structure shown in FIG. 20 can be obtained so that constraints on torque values can be hierarchically considered. Although the hierarchical structure shown in FIG. 20 has two hierarchical levels, the number of hierarchical levels is not limited. The number of hierarchical levels can be increased in accordance with the number and types of requests.

Thirteenth Embodiment

A thirteenth embodiment of the present invention will now be described with reference to FIG. 21.

The thirteenth embodiment is based on the second embodiment and is characterized in that a request group into which a plurality of requests are grouped is formed to reset the distribution of constraint index values for the request group. In the example shown in FIG. 21, Constraints 1, 2, 3, and 4 belong to a request group, and the result of integration of Constraints 1, 2, 3, and 4 is depicted as Constraint X. Constraint X is set on the basis of Constraint-total, namely, the distribution of integrated constraint index values that are obtained when the constraint index values of individual requests are integrated on an individual torque value basis.

Figure 21:
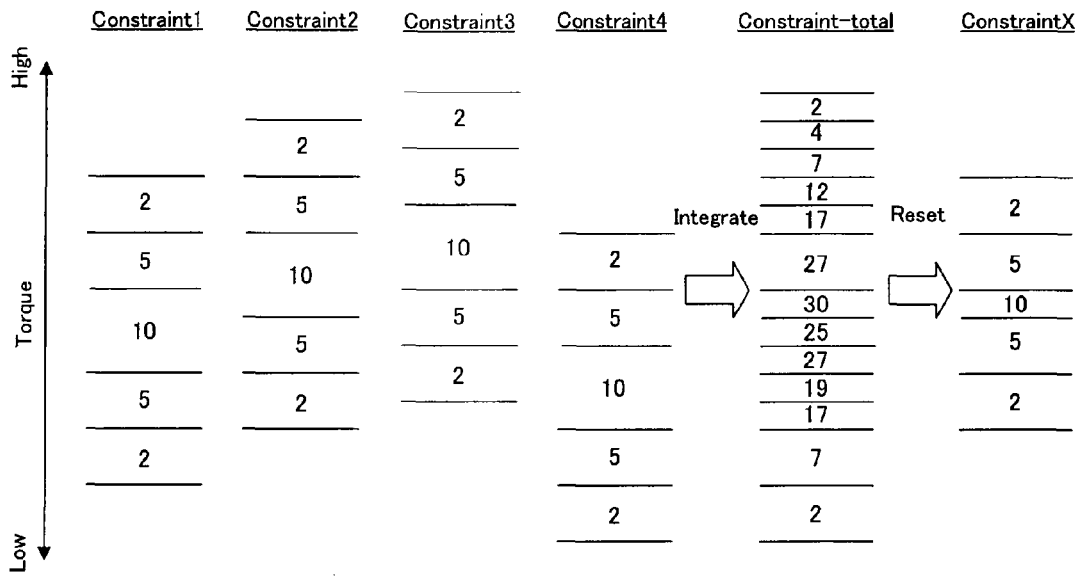
FIG. 21 is a diagram illustrating a limitation determination method employed in a thirteenth embodiment of the present invention.

The control device according to the thirteenth embodiment additionally performs the above-described process on the other requests to set a plurality of request-group-specific limitations as indicated in FIG. 21. The constraint index values assigned to individual torque values on an individual request group basis are then integrated for each torque value. In accordance with the distribution of the resulting integrated constraint index values for the torque values, the control device determines the torque limitation and sets the target torque within the range of the torque limitation. As a result, the hierarchical structure shown in FIG. 20 is obtained, as is the case with the twelfth embodiment, so that constraints on torque values can be hierarchically considered. In the thirteenth embodiment, each constraint is quantified by the constraint index value. This makes it possible to weight the request groups in such a manner that the importance of each request group is reflected in the target torque setting.

Other

While the present invention has been described in connection with the foregoing embodiments, it should be understood that the present invention is not limited to the foregoing embodiments. The present invention extends to various modifications that nevertheless fall within the scope and spirit of the present invention.

For example, the foregoing embodiments assume that torque is handled as an engine control amount. However, the present invention can also be applied to the determination of a target control amount value other than the torque. More specifically, the present invention is also applicable to the determination of a target control amount value such as an air-fuel ratio or efficiency.

Further, although the thirteenth embodiment is based on the second embodiment, the technical features offered by the thirteenth embodiment can also be applied to the third to eleventh embodiments in which each constraint is quantified by the constraint index value.

The invention claimed is:

1. A control device for controlling an internal combustion engine in accordance with a target value of a control amount, the control device comprising:

constraint setup means for acquiring various requests concerning the performance of the internal combustion engine, setting a request-specific constraint for the value of the control amount, wherein the constraint is expressed as a set of constraint index values assigned to individual control amount values, and the distribution of the constraint index values assigned to the control amount values varies in accordance with the type of a request;

integration means for integrating, for each control amount value, the constraint index values assigned to individual requests with respect to each control amount value;

limitation determination means for determining a limitation of the control amount, the limitation being defined by an upper-limit value and a lower-limit value, in accordance with the distribution of the integrated constraint index value for the control amount;

target value determination means for determining a target value of the control amount within the limitation; and control means for controlling the internal combustion engine in accordance with the target value of the control amount.

2. The control device according to claim 1, wherein the constraint setup means divides the control amount into a plurality of bands and uses a discrete value as the constraint index value, the discrete value being assigned to each band.

3. The control device according to claim 1, wherein the constraint setup means uses a continuous value as the constraint index value, the continuous value being continuous in each value of the control amount.

4. The control device according to claim 1, wherein the constraint setup means varies the distribution of constraint index values to be assigned to each value of the control amount, in accordance with a change in the description of a request.

5. The control device according to claim 1, further comprising:

weighting means for weighting the constraint index values assigned to individual requests with respect to each value of the control amount, in accordance with importance of each requests;

wherein the integration means integrates the weighted constraint index values for each value of the control amount.

6. The control device according to any one of claim 1, wherein the constraint setup means assigns the constraint index value such that the more appropriate the value of the control amount is for the description of a request, the greater the constraint index value assigned to the value of the control amount will be with reference to a predetermined finite value.

7. The control device according to claim 6, wherein the limitation determination means uses a band in which the integrated constraint index value exceeds a predetermined threshold value, as the limitation.

8. The control device according to claim 7, wherein the limitation determination means varies the predetermined threshold value in accordance with the operating environment of the internal combustion engine.

9. The control device according to claim 6, wherein the limitation determination means selects such a threshold value that a band in which the constraint index value exceeds the threshold value has a predetermined width, and uses a band defined by the threshold value as the limitation.

10. The control device according to claim 8, wherein the limitation determination means varies the predetermined width in accordance with the operating environment of the internal combustion engine.

11. The control device according to claim 1, wherein the constraint setup means assigns the constraint index value such that the more inappropriate the value of the control amount is for the description of a request, the greater the constraint index value assigned to the value of the control amount will be with reference to a predetermined finite value.

12. The control device according to claim 11, wherein the limitation determination means uses a band in which the integrated constraint index value is smaller than a predetermined threshold value, as the limitation.

13. The control device according to claim 12, wherein the limitation determination means varies the predetermined threshold value in accordance with the operating environment of the internal combustion engine.

14. The control device according to claim 11, wherein the limitation determination means selects such a threshold value that a band in which the constraint index value is smaller than the threshold value has a predetermined width, and uses a band defined by the threshold value as the limitation.

15. The control device according to claim 14, wherein the limitation determination means varies the predetermined width in accordance with the operating environment of the internal combustion engine.

16. A control device for controlling an internal combustion engine in accordance with a target value of a control amount, the control device comprising:

constraint setup means for acquiring various requests concerning the performance of the internal combustion engine, setting a request-specific constraint for the value of the control amount, wherein the constraint is expressed as a set of constraint index values assigned to individual control amount values, and the distribution of the constraint index values assigned to the control amount values varies in accordance with the type of a request;

constraint resetup means for setting a plurality of request groups, each of the groups including a plurality of requests, integrating the constraint index values assigned to individual requests with respect to each value of the control amount on an individual request group basis, and resetting the distribution of the constraint index values in each request group in accordance with the distribution of the integrated constraint index values;

integration means for integrating the constraint index values assigned to each request group with respect to each value of the control amount on an individual control amount value basis;

limitation determination means for determining a limitation of the control amount, the limitation being defined by an upper-limit value and a lower-limit value, in accordance with the distribution of the integrated constraint index values for the control amount;

target value determination means for determining a target value of the control amount within the limitation; and control means for controlling the internal combustion engine in accordance with the target value of the control amount.

17. A control device for controlling an internal combustion engine in accordance with a target value of a control amount, wherein the control device is programmed to:

acquire various requests concerning the performance of the internal combustion engine;

set a request-specific constraint for the value of the control amount, wherein the constraint is expressed as a set of constraint index values assigned to individual control amount values, and the distribution of the constraint index values assigned to the control amount values varies in accordance with the type of a request;

integrate, for each control amount value, the constraint index values assigned to individual requests with respect to each control amount value;

determine a limitation of the control amount, the limitation being defined by an upper-limit value and a lower-limit value, in accordance with the distribution of the integrated constraint index value for the control amount;

determine a target value of the control amount within the limitation; and control the internal combustion engine in accordance with the target value of the control amount.

* * * * *